US007762410B2

(12) United States Patent
Colin et al.

(10) Patent No.: US 7,762,410 B2
(45) Date of Patent: Jul. 27, 2010

(54) MODULAR DISPLAY RACK

(75) Inventors: Maria Alejandra Noble Colin, Del Magdalena Contreras (MX); Juan Manuel Avila Barriga, Mexico (MX)

(73) Assignee: Sabritas, S. de R.L. de C.V., Colonia Lomas de Chapultepec, D.F. (MX)

( * ) Notice: Subject to any disclaimer, the term of this patent is extended or adjusted under 35 U.S.C. 154(b) by 902 days.

(21) Appl. No.: 11/565,349

(22) Filed: Nov. 30, 2006

(65) Prior Publication Data

US 2008/0128319 A1 Jun. 5, 2008

(51) Int. Cl.
*A47B 43/00* (2006.01)
*A47B 47/00* (2006.01)
*A47B 57/00* (2006.01)

(52) U.S. Cl. ..... 211/187; 211/59.2; 211/126.2; 108/107

(58) Field of Classification Search ... 211/126.1–126.9, 211/126.11, 126.16, 128.1, 129.1, 130.1, 211/131.1, 132.1, 133.1–133.6, 189, 194, 211/195, 71.01, 85.15, 85.26, 134, 186–188, 211/153, 103, 190, 207, 135, 184, 59.2, 208; 206/503; 220/676, 675, 671, 4.28, 4.34; 221/64; 108/107–110, 147.16; 312/271, 312/108, 111

See application file for complete search history.

(56) References Cited

U.S. PATENT DOCUMENTS 293,151 A * 2/1884 Danner ..... 108/103
903,377 A * 11/1908 Hebestreit ..... 294/144
1,355,486 A * 10/1920 Longenecker ..... 211/126.2
1,805,989 A * 5/1931 Levene ..... 108/1
2,235,709 A * 3/1941 Hearn ..... 206/449
2,309,435 A * 1/1943 Bitney ..... 211/133.2
D154,300 S * 6/1949 Morris ..... D19/92
2,894,640 A * 7/1959 Bryant ..... 211/126.5
2,901,120 A * 8/1959 Abrahamson ..... 211/126.12
3,393,808 A * 7/1968 Chirchill ..... 211/59.2
3,648,849 A * 3/1972 Harris et al. ..... 211/126.12
4,074,810 A * 2/1978 Juergens et al. ..... 211/11
D249,048 S * 8/1978 Drell et al. ..... D19/92
4,138,015 A * 2/1979 Rabley ..... 206/561
4,785,939 A * 11/1988 Huerto et al. ..... 206/511
4,901,872 A * 2/1990 Lang ..... 211/126.12
4,981,224 A * 1/1991 Rushing ..... 211/126.12
5,000,329 A * 3/1991 Luberto ..... 211/132.1

(Continued)

*Primary Examiner*—Darnell M Jayne
*Assistant Examiner*—Stanton L Krycinski
(74) *Attorney, Agent, or Firm*—Colin P. Cahoon; Bobby W. Braxton; Carstens & Cahoon, LLP

(57) ABSTRACT

A modular display rack capable of multi-unit stacking and simultaneously accommodating trays in either a gravitational-feed orientation or a non-gravitational-feed orientation. A preferred embodiment comprises: a first tray and a second tray, wherein each one of said trays comprises a left tray panel, a right tray panel, a front tray panel, a rear tray panel, and a bottom tray panel; a first pillar, a second pillar, and a third pillar; wherein the second tray is aligned above the first tray, and the first and second trays are spaced apart and secured in their relative positions by shared attachment to the first, second, and third pillars such that: the first pillar is adjacent to the trays' left tray panels; the second pillar is adjacent to the trays' right tray panels; and the third pillar is adjacent to the trays' rear tray panels.

9 Claims, 11 Drawing Sheets

U.S. PATENT DOCUMENTS 5,054,629 A * 10/1991 Breen ..... 211/126.12
5,127,340 A * 7/1992 Maro et al. ..... 108/107
5,601,036 A * 2/1997 Kieser et al. ..... 108/107
6,202,570 B1 * 3/2001 Kurtsman ..... 108/108
D451,306 S * 12/2001 Dow ..... D6/474
D522,061 S * 5/2006 Chen et al. ..... D19/92
D523,088 S * 6/2006 Chien ..... D19/92
2005/0162051 A1 * 7/2005 Madsen et al. ..... 312/287

* cited by examiner

MODULAR DISPLAY RACK

BACKGROUND OF THE INVENTION

1. Technical Field

The present invention relates generally to a display shelving system. More specifically, the invention relates to a plastic rack display having shelves that are easily moved into a display position and a loading position. The display position inclines individual product shelves or trays so that the product is gravity fed to the front of each shelf while the loading position places the shelves on a horizontal orientation.

2. Description of Related Art

Retail display shelving commonly used in grocery stores, department stores, discount stores, and other retail outlets that display items on shelves, are manufactured by numerous companies in a plethora of models and design choices. The units that are typically found in a grocery store to display items for sale, such as bags of salty snacks, are typically self-contained with multiple shelves.

Although there are variations amongst the units offered by different manufacturing companies, the basic design is fairly well established, and there are many common features shared industry wide. In the prior art, a common display apparatus is a gondola-type unit, which typically has a back panel vertically oriented and held in position by connection to at least one upright, which is also vertically oriented. The connection to the upright is accomplished by at least a bottom rail, a center rail, and a top rail, although more horizontal rails can be used for this purpose. The vertical uprights are stabilized by at least one, and typically two, base legs or brackets. One or more shelves can be horizontally positioned in numerous locations relative to the back panel by virtue of connections between the shelf and the uprights. A disadvantage of such a gondola system is that many such systems require heavy, metal parts. Often, they are not stackable, combinable units; thus, as stand-alone units, they make inefficient use of the available space. Still, many are non-adjustable and/or offer only one possible arrangement of parts.

In certain circumstances, gravity-feed displays may be more desirable than displays with horizontal, level trays, while in other circumstances, the opposite may be true. For example, in gravity-feed displays having multiple shelves per column, it can be quite difficult to access product on sloped shelving, particularly when such shelving is near the ground. More specifically, it can be difficult for consumers to bend down to access the lower trays and then reach up between adjacent shelves to retrieve product. In this situation, a display having horizontally-oriented trays (at least in that lower area) would be more appropriate. However, if the tray or trays in question are chest-high or above, the consumer may find that gravity-feed trays (inclined trays) are easier to use than horizontal trays. As product is placed onto a gravity-fed shelf, the product tends to slide down to the lower, front side of the shelf, eliminating the need for the consumer to reach up, over, and towards the rear of the higher trays. It would therefore be desirable for a single display rack to accommodate trays of a horizontal orientation as well as a gravity-feed/inclined orientation.

Nothing in the prior art addresses the problem associated with providing modular, stackable, combinable, display units in a lightweight, sturdy, variable format. Furthermore, a need exists for a display system capable of simultaneously accommodating trays in either a gravitational-feed orientation or a non-gravitational-feed orientation (i.e. horizontal). The present invention fills these needs and other needs as detailed more fully below.

BRIEF SUMMARY OF THE INVENTION

The present invention relates to a modular display rack that is capable of multi-unit stacking and simultaneously accommodating trays in either a gravitational-feed orientation or a non-gravitational-feed orientation. A preferred embodiment comprises: a first tray and a second tray, wherein each one of said trays comprises a left tray panel, a right tray panel, a front tray panel, a rear tray panel, and a bottom tray panel; a first pillar, a second pillar, and a third pillar; wherein the second tray is aligned above the first tray, and the first and second trays are spaced apart and secured in their relative positions by shared attachment to the first, second, and third pillars such that: the first pillar is adjacent to the trays' left tray panels; the second pillar is adjacent to the trays' right tray panels; and the third pillar is adjacent to the trays' rear tray panels. Moreover, the present invention provides a lightweight, sturdy, variable-format alternative to prior art display systems.

The invention accordingly comprises the features described more fully below, and the scope of the invention will be indicated in the claims. Further objects of the present invention will become apparent in the following detailed description.

BRIEF DESCRIPTION OF THE DRAWINGS

The novel features which are characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

Like reference numerals represent equivalent parts throughout the several drawings.

REFERENCE NUMERALS

Figure 1A:
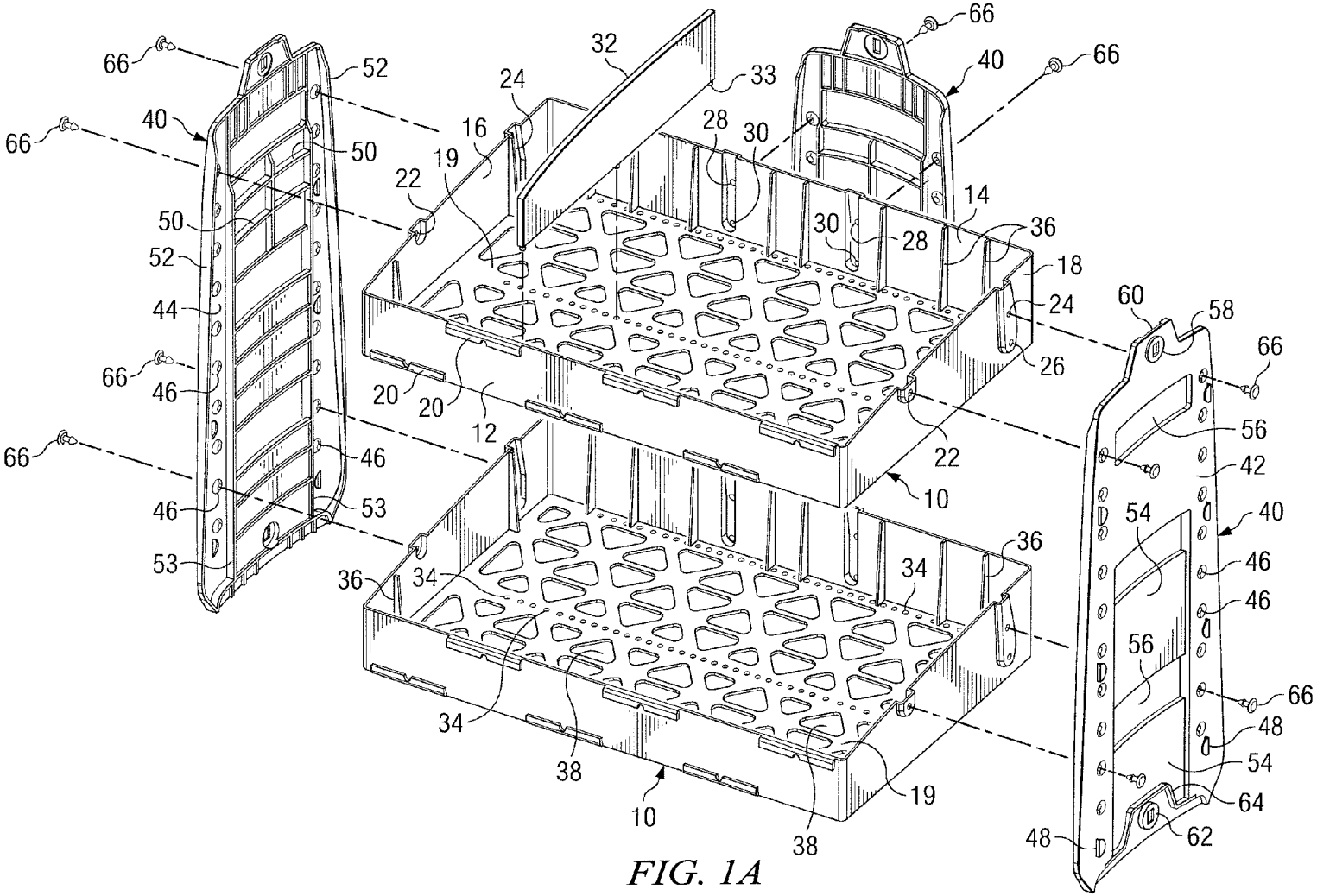
FIG. 1A is an exploded view of a modular display rack in accordance with a preferred embodiment of the invention.

10 tray
12 front tray panel
14 rear tray panel
16 left tray panel
18 right tray panel
19 bottom tray panel
20 placard-holding tabs
22 front pair of ports on the left and right tray panels
24 upper rear pair of ports on the left and right tray panels
26 lower rear pair of ports on the left and right tray panels
28 upper pair of ports on the rear tray panel
30 lower pair of ports on the rear tray panel
32 tray divider
33 divider peg
34 peg-receiving holes
36 buttress
38 triangular space
40 pillar
42 front/exterior side of pillar
44 rear/interior side of pillar
46 pushpin-receiving ports
48 placard-holding tabs
50 crossmembers
52 folded edges/periphery
53 longitudinal folds
54 recessed or inset panels
56 rectangular space
58 upper cylindrical keyhole-containing offset
60 trapezoid-like shaped portion
62 lower cylindrical keyhole-containing offset
64 trapezoid-like embossed boundary
66 pushpin fastener
68 pillar-binding turnkey
70 placard or graphics
72 offset area surrounding the upper pair of pushpin ports on the rear tray panel
74 offset area surrounding the lower pair of pushpin ports on the rear tray panel
76 offset area surrounding the pushpin ports on the left and right tray side panels
78 wall-mounting collars
80 pair of longitudinal crossmembers flanking the center line
82 crossmembers
84 wall-mounting brace
86 inner pair of V-shaped portions of wall-mounting brace
87 washers
88 outer pair of V-shaped portions of wall-mounting brace
90 wall-mounting screws

DETAILED DESCRIPTION OF THE INVENTION

A modular display rack in accordance with the present invention has several improved features in comparison to prior art modular display racks. Although the fundamental structural elements of the present invention—i.e. a plurality of trays secured by a plurality of pillars—are not unlike the main structural elements of various prior art display racks, there are several distinguishing features in these structural elements that make this display rack unique. In particular, strategically-placed skeletal reinforcements, coupled with other structurally-robust design elements, give the display rack of the present invention greater strength and rigidity while using the same or less material and/or mass.

Figure 1B:
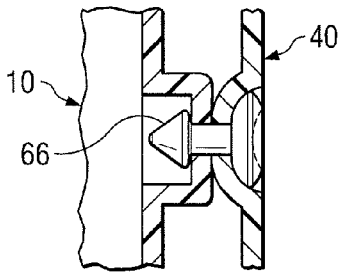
FIG. 1B is a detailed, side cross-sectional view of the interface between the pushpin-attached ports of an adjoining pair of pillar and tray.
Figure 2A:
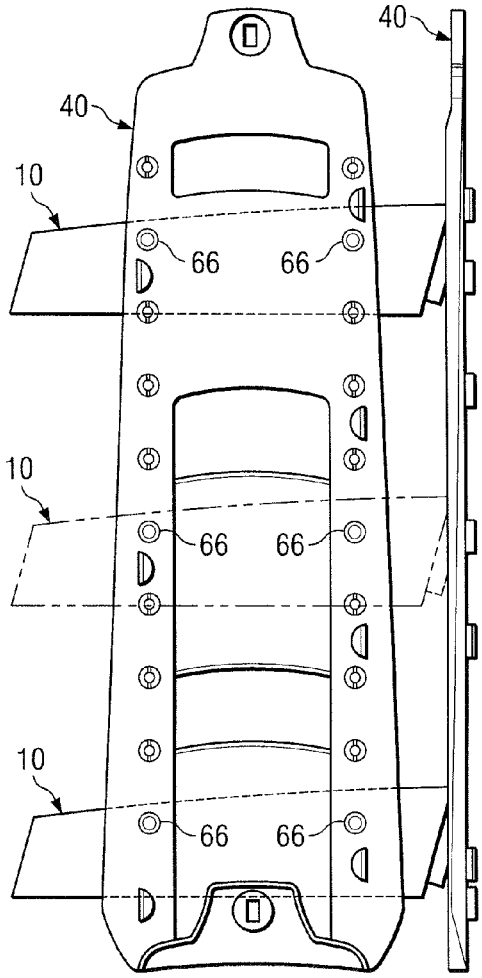
FIG. 2A is a side elevational view of an assembled modular display unit having three trays in their horizontal orientation.
Figure 2B:
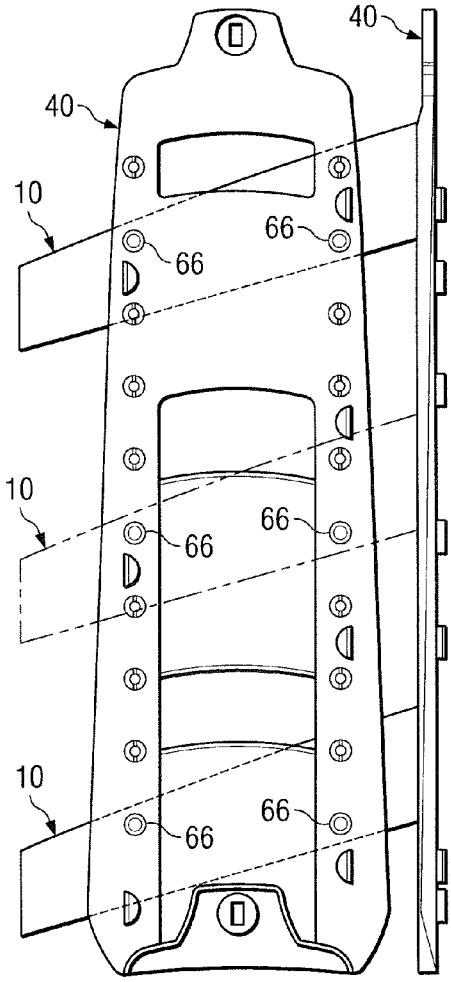
FIG. 2B is a side elevational view of an assembled modular display unit having three trays in their inclined position.
Figure 3A:
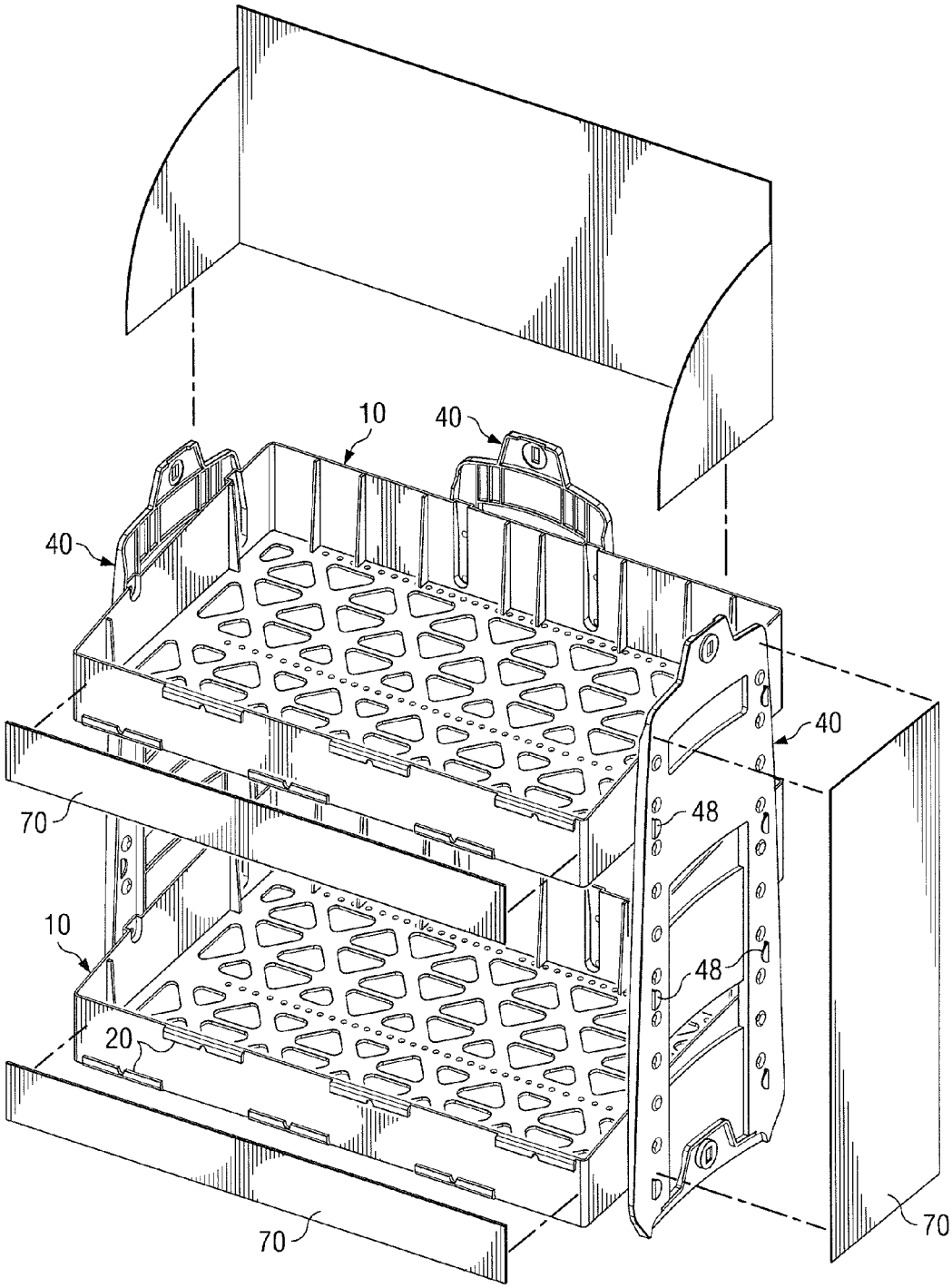
FIG. 3A is an exploded view of a modular display unit having two trays in their horizontal position and showing the placement of optional graphics/placards.
Figure 3B:
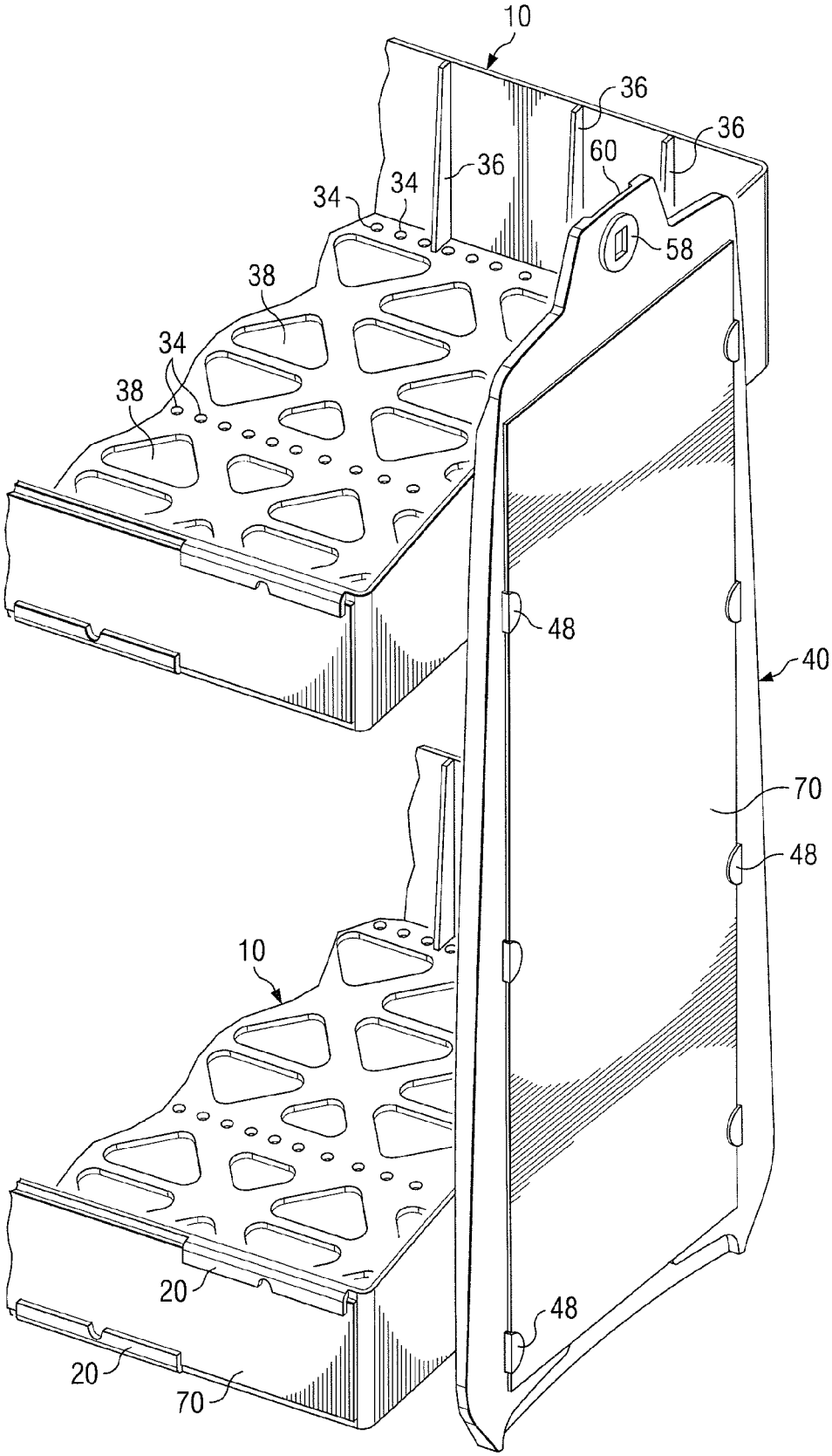
FIG. 3B is a detailed view of placards inserted into the placard slots of the trays and pillars shown in FIG. 3A.
Figure 4A:
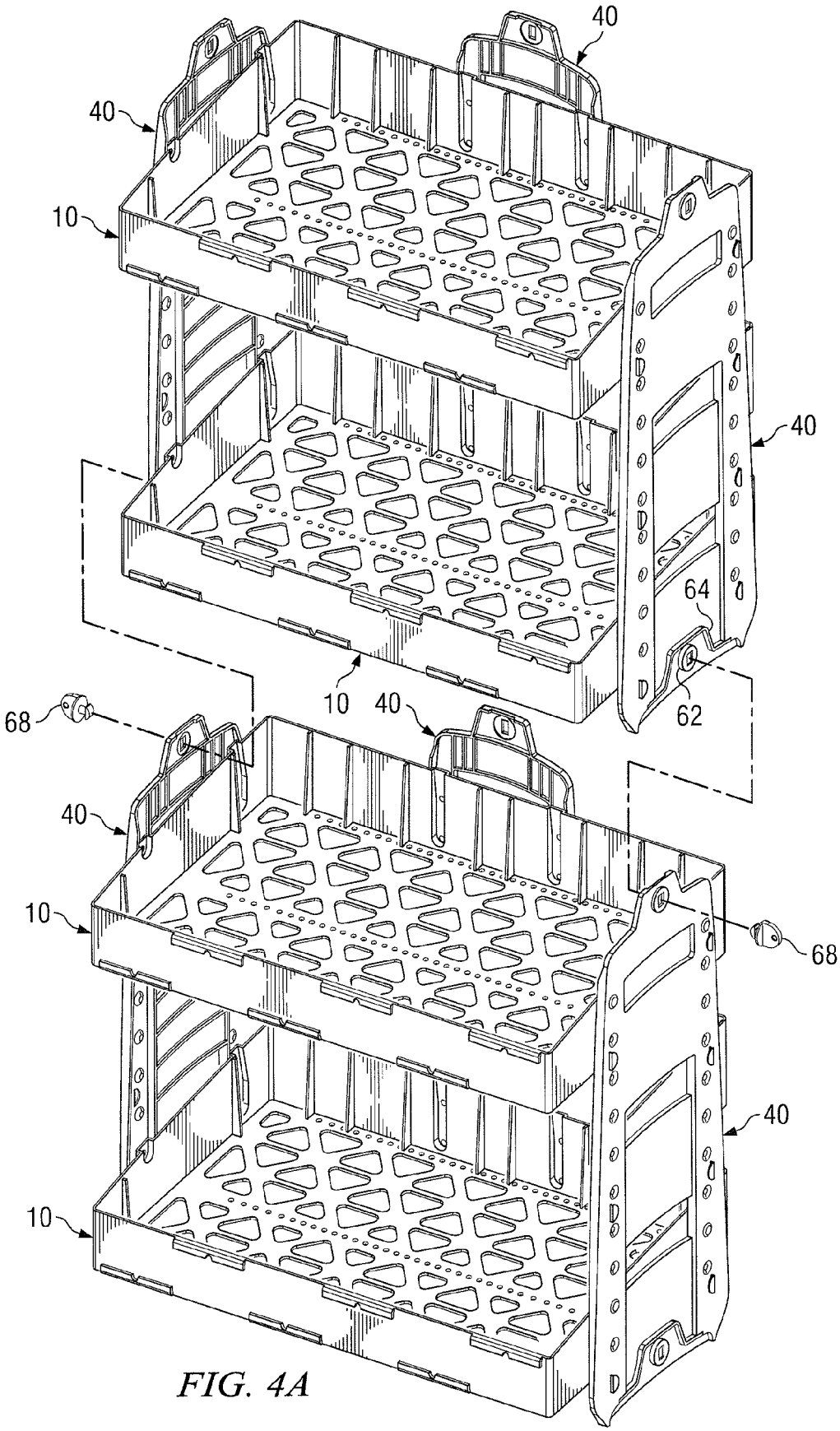
FIG. 4A is an exploded view of two modular display units aligned vertically for stacking and fastening by insertion and rotation of a pair of locking keys (i.e. "pillar-binding turnkeys")
Figure 4B:
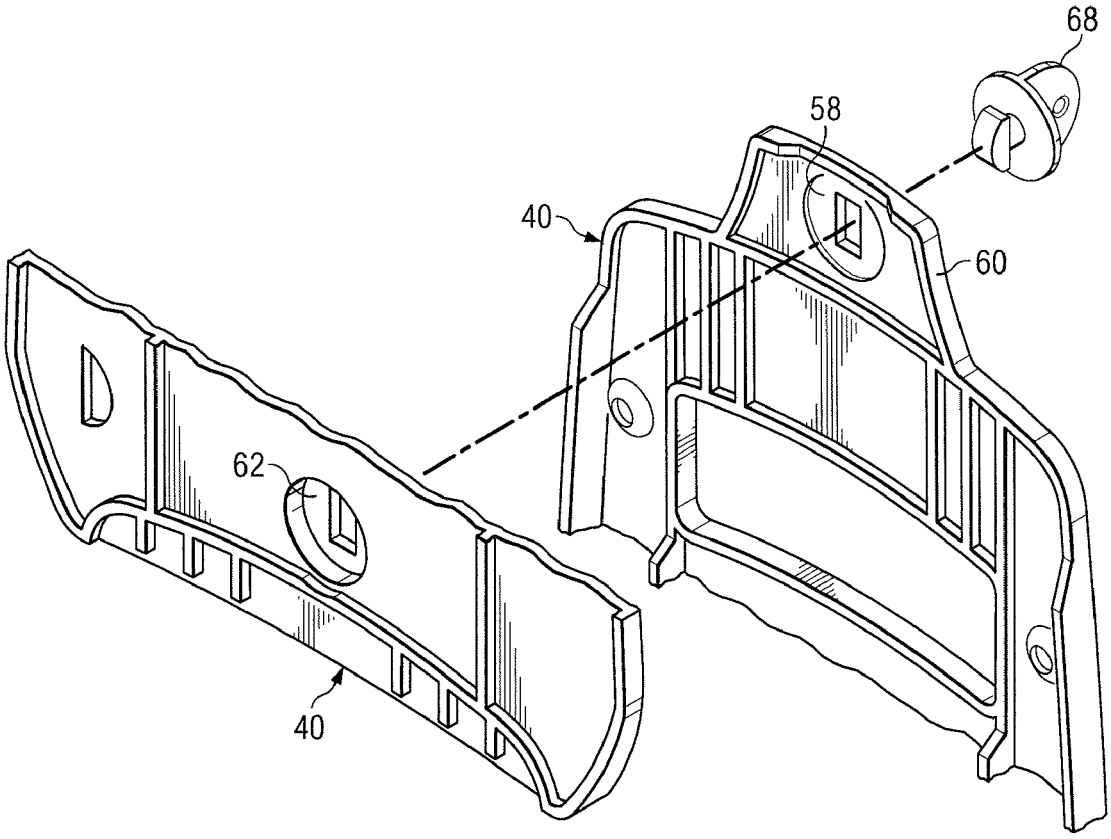
FIG. 4B is a detailed, exploded view of the interlocking portions of two adjacent pillars and a pillar-binding turnkey prior to interlocking.
Figure 4C:
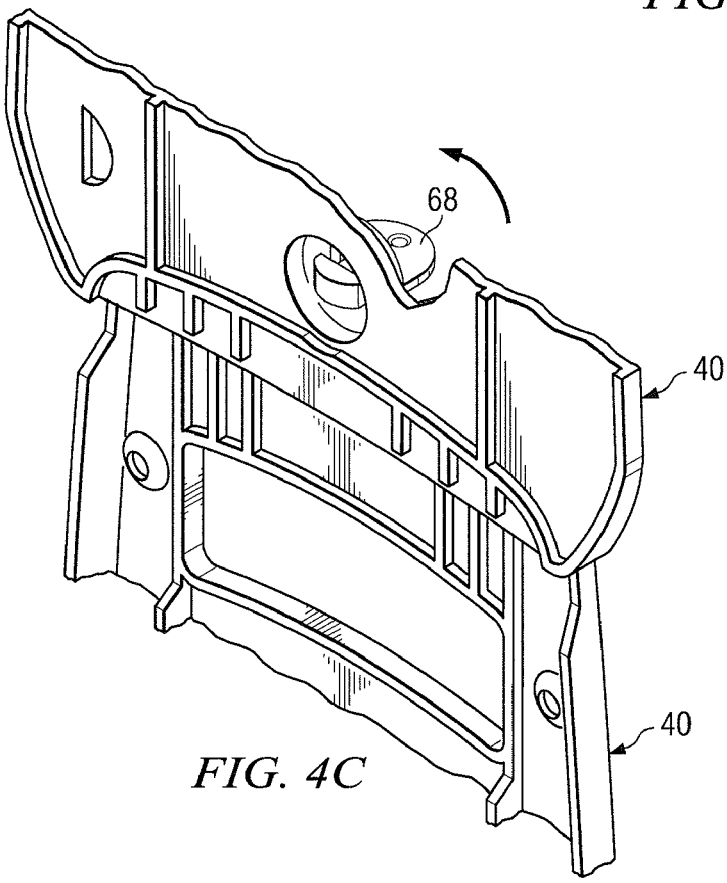
FIG. 4C is a detailed view of the interlocking portions of two adjacent pillars and a locking key after interlocking.
Figure 5A:
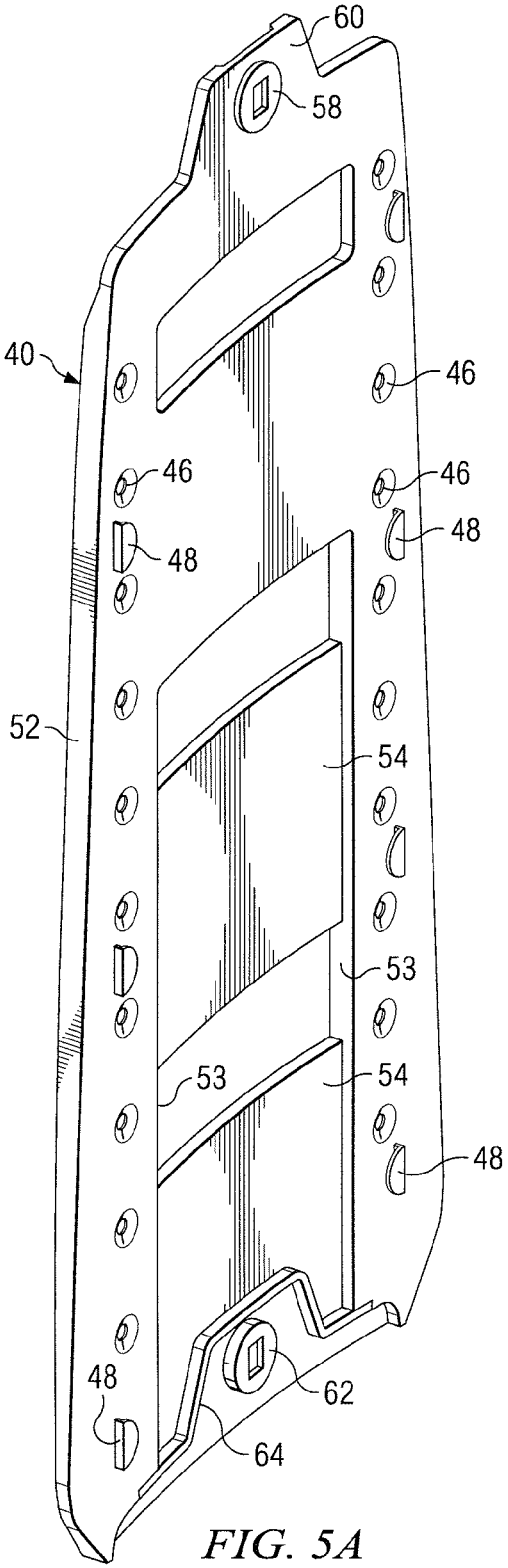
FIGS. 5A and 5B show the front/exterior and back/interior views, respectively, of a pillar in accordance with a preferred embodiment of the present invention.
Figure 5B:
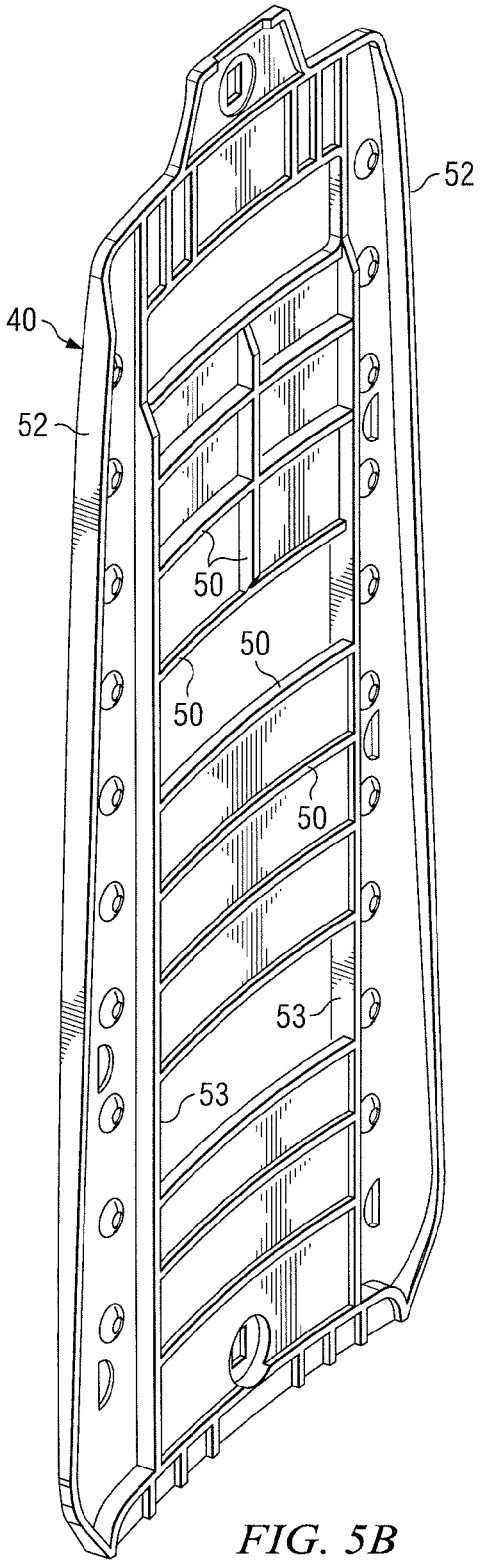
Figure 6A:
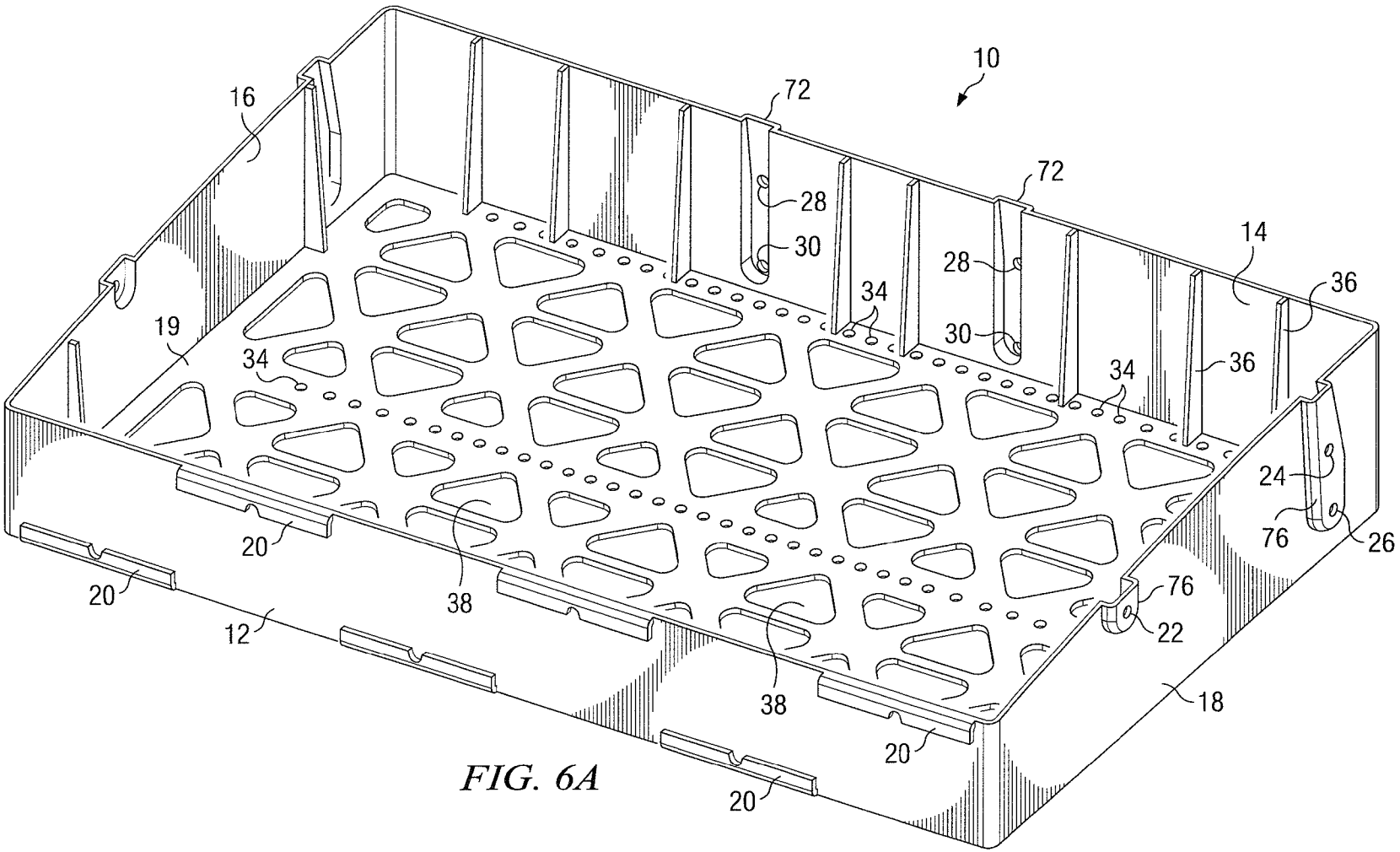
FIGS. 6A and 6B show upper and lower perspective views of a tray in accordance with a preferred embodiment of the present invention.
Figure 6B:
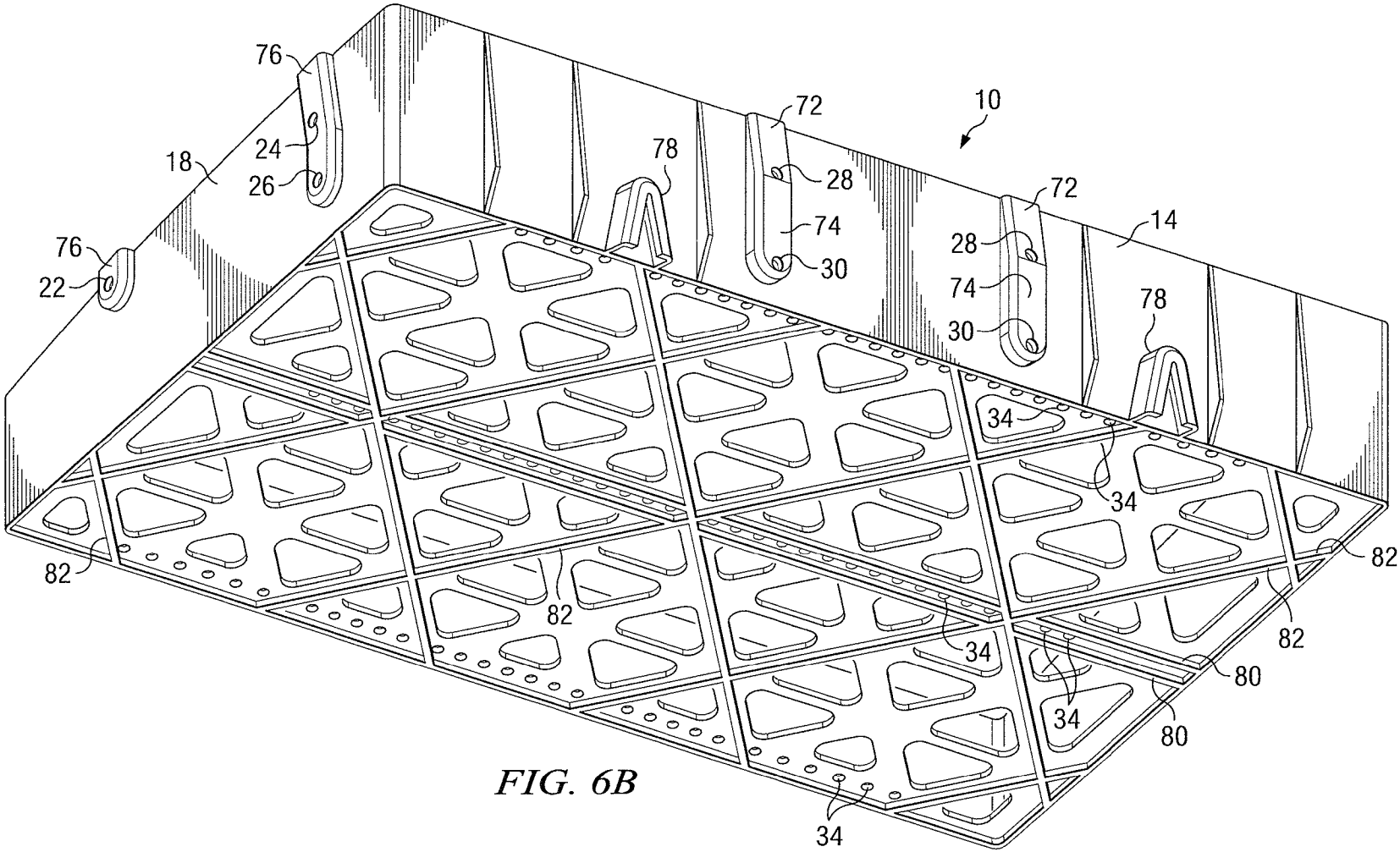
Figure 7A:
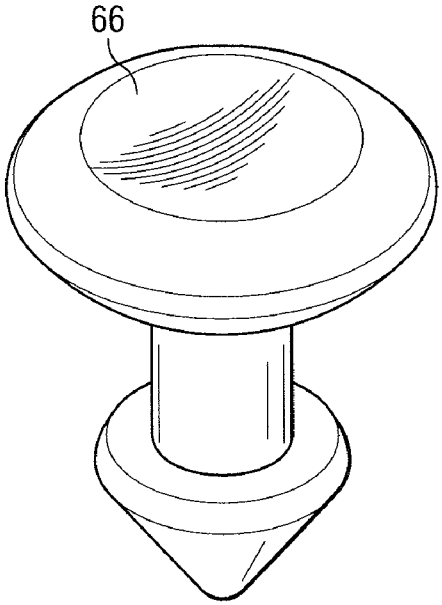
FIGS. 7A and 7B show a perspective view and a side cross-sectional view, respectively, of a push-pin fastener in accordance with a preferred embodiment of the invention.
Figure 8A:
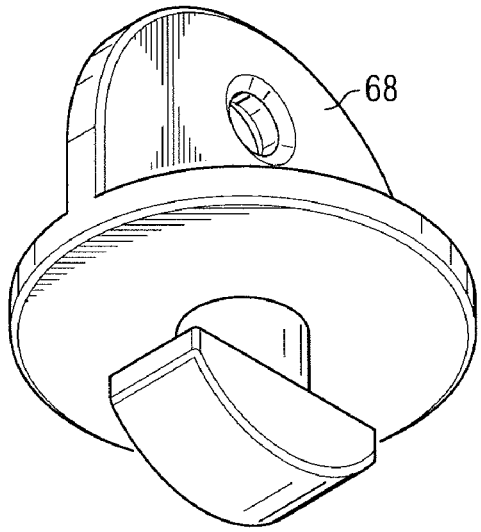
FIGS. 8A and 8B show upper and lower perspective views of a pillar-binding turnkey in accordance with a preferred embodiment of the present invention.
Figure 7B:
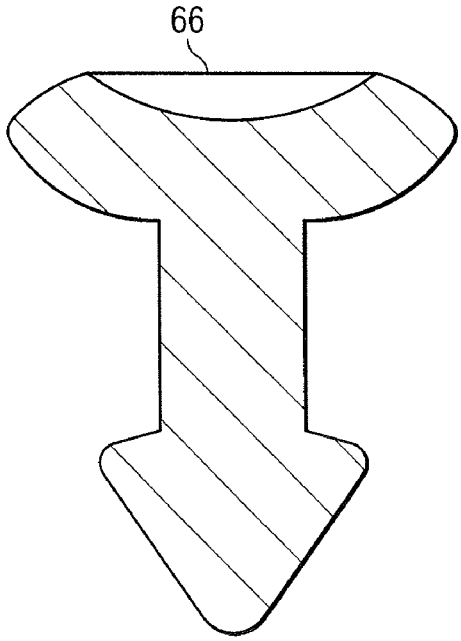
Figure 8B:
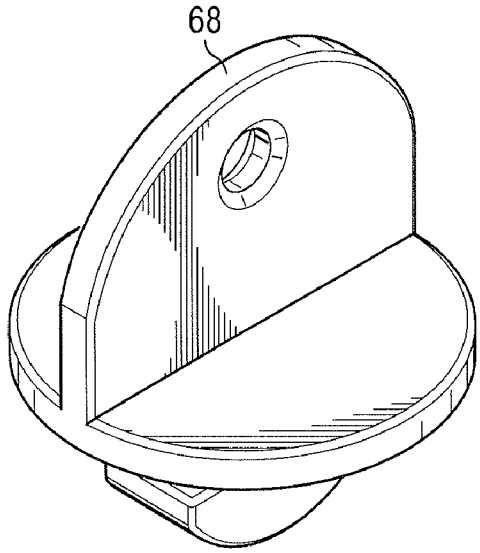
Figure 9:
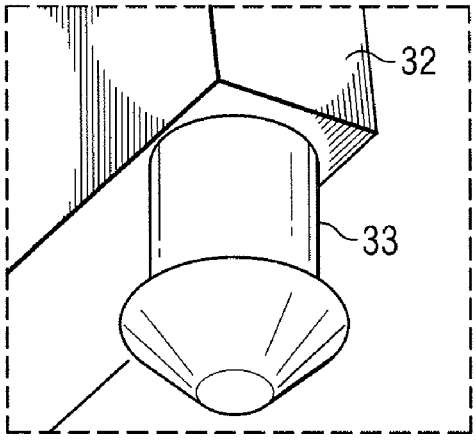
FIG. 9 includes a detailed view of a mounting peg/prong at the bottom of a tray divider in accordance with a preferred embodiment of the present invention.
Figure 10:
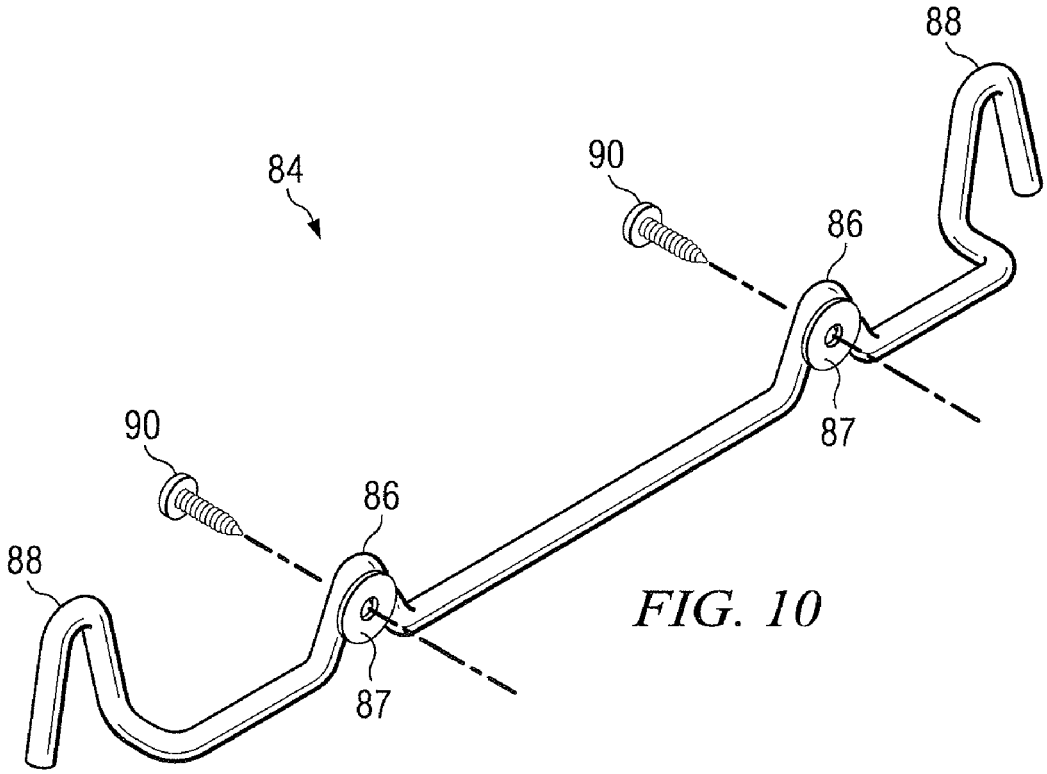
FIG. 10 is a perspective view of a wall-mounting brace for wall-mounting a modular display rack in accordance with the present invention.

FIGS. 1 through 10 have been provided herein to aid the reader in understanding the following written description of a preferred embodiment of the present invention. Referring now to the provided drawings, similar reference numerals represent the equivalent component(s) throughout the several views of the drawings—i.e. unless otherwise stated, the various structural elements of the invention are identified with the same set of reference numerals throughout all of the figures. Note, however, that the specific, preferred embodiment of a modular display rack illustrated in the figures is not intended to be limiting; it should be understood that the invention also relates to obvious variations that may be made to accommodate the particular physical application and/or end-user.

Fundamentally, a modular display rack, as embodied by the present invention, comprises a plurality of two major structural elements: product-holding trays 10 and vertical support panels 40 (which vertical support panels may be referred to more simply herein as "pillars"). In practice, two or more product trays 10 are arranged and aligned one over the other in a vertical column, spaced apart and secured by two or more pillars 40. As can be seen in FIGS. 1 through 10, a preferred embodiment has at least three generally-rectangular (or otherwise elongate) trays 10 secured one above the other by three pillars 40—one at either side, and one at the rear side. Note, however, that fewer numbers or greater numbers of pillars 40 and trays 10 may be used. For example, a modular display rack using the trays 10 and pillars 40 described herein might simply have two trays 10 secured one above the other between two pillars 40. In yet another example, a modular display rack might have four trays 10 secured one above the other between two pillars 40. In still another example, a modular display rack might have three modular units stacked one atop the other, with each unit comprising three trays 10 secured by three pillars 40, or perhaps with each unit having different numbers of trays 10 and/or tray orientations (horizontal or inclined). To establish proper support in multi-unit displays, however, each unit should preferably have pillars 40 on three sides, rather than on merely two sides. The trays 10 are preferably secured to the pillars 40 by pushpin-type fasteners, although other fasteners can be used, including but not limited to: threaded screws and ports, metal or plastic; hex bolts; carriage bolts; set screws and threaded ports; bolts and nuts (and washers, optionally); anchors; rivets. Assembled display rack units can be stacked and secured together by turnkey locks 68. Although the trays 10, pillars 40, pushpin-type fasteners 66, and turnkey locks 68 can be made of any fairly-rigid material, they are preferably made of plastic. Examples of acceptable materials include, but are not limited to: polyethylene terephthalate (PET or PETE), high density polyethylene (HDPE), polyvinyl chloride (PVC), low density polyethylene (LDPE), and polypropylene (PP). The trays 10 and pillars 40 are most preferably made of polypropylene, although other plastics and even some composites will serve well in this application.

In a preferred embodiment, each tray side 14, 16, 18 encountering a pillar 40 attaches to its respective pillar 40 with two pushpin-type fasteners 66—in particular, two plastic countersunk rivets. The exterior face 42 of each pillar 40 preferably has concave seats, receptacles, ports, or eyelash-type sockets 46 corresponding to, and for receiving, the countersunk pushpin fasteners 66. Likewise, each tray side encountering a pillar 40 also has corresponding holes or ports 22-30 for receiving the ends of the pushpin fasteners 66. As will be described in more detail below, each tray side 16, 18 also has an additional set of pushpin-receiving holes (or ports) 46 for securing each tray in an alternate orientation: thus, this additional set of holes enables each tray to be secured in at least two orientations—i.e. a horizontal orientation and an inclined orientation.

Depending on the location and/or use of the display rack, one tray orientation may be more preferable than the other. For example, when the display rack is viewed from the front, a horizontal tray orientation might appear more spacious and less-cluttered than an inclined orientation might appear. On the other hand, where the display rack is placed in a relatively low position, such as near or on the ground, an inclined, gravity-feeding tray position may be more appropriate, as consumers may find it difficult to reach down and to the rear of a horizontally-oriented tray to retrieve product.

The vertical location and the orientation (or the 'elevation' and 'pitch,' as they might be termed in the field of aviation) of the trays 10, relative to the supporting pillars 40, are determined by (and are also varied by) the particular alignment of pushpin-receiving ports 22-30, 46 of the pillars and the trays, as well as the particular placement of the pushpin fasteners 66 within such aligned ports. More specifically, the vertical location of the trays 10 depends on which lateral set of pushpin-receiving ports 66 are selected, as the lateral sets are distributed across various elevations on each pillar. The pitch of each tray (i.e. whether a given tray is maintained horizontally or at an incline—'incline' meaning the rear of the tray 14 is at a higher elevation than the front of the tray 12) is determined by the particular pushpin-receiving ports 22-30 (of the given tray) chosen to align with the selected lateral set of pushpin-receiving ports 46 of the pillars. For example, note that each tray 10 in a preferred embodiment of the invention has a total of ten pushpin-receiving ports: three on each of either side (three on the left/three on the right), and four on the rear/back side. The ten ports can also be viewed as belonging to the following two groups (with the front pair of ports appearing in both groups): a horizontal-positioning group comprising the front pair of ports on the left and right sides of the tray 22, the upper pair of rear ports on the left and right sides of the tray 24, and the upper pair of ports on the rear side of the tray 28; an inclined-positioning group comprising the front pair of ports on the left and right sides of the tray 22, the lower pair of rear ports on the left and right sides of the tray 26, and the lower pair of ports on the rear side of the tray 30.

The ten ports, which can be grouped as explained above into a horizontal-positioning group and an inclined-positioning group, can also be described as belonging to differing geometric planes: wherein the front pair of ports on the left and right tray panels, the upper rear pair of ports on the left and right tray panels, together with the upper pair of ports on the rear tray panel, define a plane that parallels the bottom tray panel; and wherein the front pair of ports on the left and right tray panels, the lower rear pair of ports on the left and right tray panels, together with the lower pair of ports on the rear tray panel, define a plane that forms an acute angle with a plane containing the bottom tray panel.

The figures include a pair of side profile views of the display rack, where one side profile illustrates three trays 10 in a horizontal orientation, and the other side profile illustrates three trays 10 in an inclined orientation. Note, however, that, while the horizontally-oriented trays 10 and the inclined trays 10 are shown in separate side profile views, both orientations, in practice, can appear in the same display rack.

In addition to varying the vertical position and the attitude/orientation of the trays, the user can also vary the number of trays 10 used in each display unit. For example, the particular embodiment of a modular display rack unit shown in the figures has three trays 10 evenly spaced apart. A smaller number or a greater number of trays, however, can alternatively be used. The maximum number of trays 10 that can be installed on a given unit depends on the number of lateral pairs of push-pin-receiving ports 46 on each pillar 40, the distance between each lateral set of ports 46, as well as the dimensions of the trays 10—i.e. tray height—and orientations of the trays 10 relative to one another.

The pillar 40 and tray 10 components both have strategically-placed skeletal reinforcements for enhancing the structural strength and rigidity of those components, as well as the entire display rack. Regarding the trays 10 in a preferred embodiment, for example, each tray 10 has crossmembers 80, 82 permanently attached to, or, more preferably embossed upon, its surfaces. Looking at the exterior of the bottom surface of one of the illustrated trays 10, one can see longitudinal crossmembers 80, as well as crisscrossing crossmembers 82 which form both acute and obtuse angles with the trays' sides. The specific embodiment of the tray 10 shown in the figures has a pair of longitudinal crossmembers 80 flanking the centerline, which centerline has a plurality of holes 34 spaced across the tray width. As an aside, each centerline hole 34 is aligned with a corresponding hole 34 near the front of the tray and with a corresponding hole 34 near the rear of the tray; these triplets of holes define the possible lateral locations for releasably/removeably securing a tray divider 32 within the interior of the tray. Each triplet preferably runs parallel to the left and right tray panels 16, 18. Returning to the topic of structural reinforcements, the tray 10 shown also has several crossmembers 80, 82 that form approximately 45° (degree) angles and 135° (degree) angles with the tray's sides, thereby defining various three-sided 38 and five-sided patterns throughout the external bottom surface of the tray 19. While there are various prior art methods for attaching and/or forming crossmembers on the present invention's tray surfaces and pillar surfaces, one preferred method is by embossing—i.e. raising a design in relief against a surface, such as by stamping a plastic panel with a crossmember-pattern-engraved press.

To increase the strength-to-weight ratio of each tray, dispersed sections of the tray bottom can optionally be removed or otherwise designed to be without material, so long as the crossmember elements remain intact. For example, the particular tray 10 illustrated in the figures has a plurality of triangular spaces (or cut-outs) dispersed in alternating orientations throughout the tray's bottom panel. In fact, the panel material surrounding—and thus defining—those dispersed spaces form a pattern of crisscrossing and longitudinally-spanning panel material that complements the pattern formed by the crossmember elements.

With respect to the interior portions of a tray 10 in accordance with a preferred embodiment of the present invention, the interior faces of the tray front 12, tray sides 16 18, and tray rear/back 14 are all structurally reinforced by a plurality of interior buttresses 36. Each interior buttress 36 extends perpendicularly and downward from the upper portion of its respective interior face to the upper, interior surface of the tray's bottom panel 19, thereby forming a triangular support.

These interior buttresses 36 can be attached, embossed, or otherwise formed as described above with respect to the crossmember elements on the exterior surface of the tray bottoms 19.

For promotional purposes, the exterior face of the front sides 12 of each tray 10 can optionally have a plurality of placard holders 20 for receiving and securing promotional placards 70 or the like. As seen in the figures, the placard holders 20 in a preferred embodiment comprise flap-like appendages extending over the front face 12 towards the longitudinal centerline from the top and bottom of the tray's exterior-facing front surface 12. Note, however, that there are other possible, suitable methods for attaching promotional material on the surfaces of the display rack.

Referring now to the pillars 40 as illustrated in the figures, the pillars 40 according to a preferred embodiment, like the above-described trays according to a preferred embodiment, have strategically-placed skeletal reinforcements for enhancing structural strength and rigidity. For example, the interior face 44 of each pillar 40 shown in the figures comprises a plurality of longitudinal and lateral crossmembers 50 extending beyond the panel surface 44. In the particular embodiment shown in the figures, each pillar 40 more specifically comprises several longitudinal, alternating, orthogonal (or right-angle) folds 53 formed from what is essentially a flat sheet or flat panel of material, such as hard plastic. Adding such folds 53—to what would otherwise be a flat panel—significantly increases the panel's load-bearing ability in the direction of the folds 53—i.e. longitudinally, and in practice, vertically. For instance, each pillar 40 shown in the figures has flared or folded periphery/edges 52, which, in an assembled display rack, point inward toward the tray(s) 10 to which the pillar 40 is attached. Moreover, in at least the middle section of each pillar 40 illustrated, another pair of longitudinal folds 53 causes at least a portion of the panel material to be recessed or inset (or offset) 54 from the surrounding portions of panel material 44.

To increase the strength-to-weight ratio of each pillar 40, dispersed sections of the pillar 40—as similarly described above with respect to the trays 10—can optionally be removed or otherwise designed to be without material, so long as the previously-mentioned longitudinal folds 53 remain intact. For example, the particular pillar 40 embodiment illustrated in the figures has a plurality of (in this case, a group of three) slightly-curved rectangular spaces 56 (or cut-outs) dispersed along the length of the pillar 40. When viewing the interior face 44 (or back side) of the pillar 40, the panel folds 52, 53 and the rectangular spaces 56 give the pillar 40 the appearance of comprising two parallel, tapering rails connected by spaced-apart, crossmember-embossed panel sections, thereby resembling a ladder.

As previously mentioned, the exterior face 42 of each pillar 40 preferably has concave seats, receptacles, ports, or eyelash-type sockets 46 corresponding to, and for receiving, the countersunk pushpin fasteners 66 used to fasten pillars 40 to trays 10 in a preferred embodiment. In the illustrated embodiment, the sockets 46 appear spaced apart in columns near the left and right sides, within the rail-like portions of each pillar 40. Although the sockets 46 are evenly spaced in a preferred embodiment, they need not be. Furthermore, if desired, the sockets 46 may also have at least a partial slit through their bottom portions, as shown in the figures, to allow for a greater degree of temporary flex or enlargement of the socket holes during installment of snap-in, push-pin type fasteners 66, such as countersunk, arrowhead, plastic rivets.

Referring, again, to the illustrated pillars: each pillar 40, like the rail-like elements contained therein, tapers slightly from bottom to top. Note, however, that other aesthetic designs are possible; for example, rather than tapering from bottom to top, each pillar 40 might alternatively comprise a perfect rectangle or other geometric shape. If desired, the pillars 40 can also further comprise placard-holding tabs 48, similar to the placard holders 20 described above with respect to the trays 20. The placard holders 20, 48 for the trays 10 and the pillars 40 can be made in numerous different ways. For example, the figures already show two variations of placard-holding elements: the holding elements 20 on the trays 10 are essentially small segments (or appendages or flaps) of the stock/panel material that extend from the main body of the front panel 12, and which flaps are folded back over the exterior of the front panel 12; the holding elements 48 of the pillars 40, in contrast, are essentially small portions of the pillars' main bodies (rather than appendages), which small portions are partially cut to define tabs or flaps that are still attached to the pillars 40, and which are then stamped, pressed, or otherwise offset beyond the front surface of the pillars 42. As is evident from the figures, placards 70 (or other promotional materials—i.e. price tags, labels, artwork, etc.) can be positioned and secured within the placard holders 48 by sliding them in between the holders 48, beginning in a position off to one side and in an orientation aligned with the holders 48.

Note, also, that each pillar 40 preferably has complementary top and bottom formations or structures 60, 64 for stacking and interlocking two or more pillars 40 vertically—i.e. top to bottom, or bottom to top. This enables the display rack units to be stackable, one atop the other. In the example shown in the figures, the complementary, interlocking structures 58, 60, 62, 64 of each pillar 40 include: a) a trapezoid-like shaped portion 60 of the panel material extending beyond the top of the general paired-railing/ladder-like portion, including a b) cylindrical, keyhole-containing portion 58 (within the trapezoid portion) that is offset from the rest of the panel material toward the front/external-facing side 42 of the pillar 40, thereby leaving a cylindrical depression on the interior 44 and a cylindrical protrusion on the exterior 42; c) an identically-shaped, trapezoid-like, embossed boundary 64, located on the already-offset/inset, central, lower panel segment 54, which panel segment spans the area between the left- and right-, rail-like sides of the pillar 40; and d) a cylindrical, keyhole-containing portion 62 (within the trapezoid portion), also offset from the rest of the panel material toward the front/external-facing side of the pillar 42, thereby leaving a cylindrical protrusion on the exterior 42. When stacking the pillars 40 of a first display rack onto the pillars 40 of a lower, second display rack: the exterior, front-facing sides 42 of the lower trapezoid portions 64 of the pillars 40 of the first display rack are such that they snugly receive the interior, rear-facing side 44 of the upper trapezoid portions 60 of the pillars 40 of the second display rack. Likewise, the lower cylindrical protrusions 62 of the first rack's pillars 40 fit snugly within the upper cylindrical depressions 58 of the second rack's pillars, with their corresponding keyhole slots being aligned. As can be seen in the figures, the so-aligned, so-interlocked, and so-stacked pillars 40 of the first and second display racks can then be locked into position by first installing, through each of the aligned sets of keyhole slots, the slot-shaped, rectangular-faced, half-cylinder mating/anchoring portion of a pillar-binding turnkey 68. Second, the turnkey 68 is rotated approximately 90° (degrees)—after the mating/anchoring portion has cleared the keyhole slots—so as to prevent the mating/anchoring portion from retreating back through the keyhole slots. Regarding the illustrated pillar-binding turnkeys 68, according to a preferred embodiment, each turnkey 68 comprises a circular collar (or plate or disc), a semicircular tab (or plate) extending perpendicularly from one side of the circular collar, and an anchoring portion (as previously described) attached to the center of the opposite side of the circular collar. Note, however, that other embodiments of a turnkey are possible, as will be understood by those skilled in the art.

Returning to the design of the trays 10 according to a preferred embodiment, the front panel 12 and the rear panel 14 of each tray 10—when viewed from the side in a horizontal orientation—are preferably inclined toward the rear so as to allow the front 12, 14 and rear panels to sit approximately vertically when the tray 10 is in an inclined orientation. Note, also, that in a preferred embodiment, the left 16, right 18, and rear 14 sides of each tray 10 have offset, protruding portions 76 surrounding the pushpin ports 22, 24, 26, 28, 30 to accommodate the various offset, folded sections of the pillars 40, as well as accommodate the variations in interface between trays 10 and pillars 40 that exists from having both a horizontal tray orientation and an inclined tray orientation. Otherwise, without such offset or extension of such pushpin ports 22, 24, 26, 28, 30, there would be a significant gap between the pushpin ports 22-30 on the trays 10 and the pushpin ports 46 on the pillars 40, which might undesirably affect the strength and quality of joinder of the trays 10 and pillars 40. For example, when looking at the offset, protruding portions 72, 74 surrounding the pushpin ports 28, 30 on the rear side 14 of each tray 10, note that the offset area 72 surrounding the upper pair of pushpin ports 46—which are used to secure the tray 10 in a horizontal orientation—is not parallel to the rear side 14 of the tray 10. Rather, this upper offset area 72 surrounding the upper pair of pushpin ports 46 is at a slant relative to the rear side 14 of the tray 10, which rear side 14 of the tray 10 is itself at an inclined angle (or slant) relative to the bottom surface of the tray 19. This upper-offset-area angle (or slant) is such that it parallels the surface of the rear pillar 40 when the tray 10 is in a horizontal position, thereby promoting flush contact with the adjacent surface of the rear pillar 40. Regarding the offset, protruding area 74 surrounding the lower pair of pushpin ports 30 on the rear side of the tray 14: note that this lower offset area 74 is parallel to the rear side of the tray 14. This promotes flush contact between the pushpin ports 46 on the adjoining pillar surface 44 and the lower pair of pushpin ports on the rear side of the tray 30 when the tray 10 is in an inclined position.

If wall-mounting of a modular display rack unit or two or more vertically-attached units is desired, a wall-mounting brace 84 is preferably used, although use of such brace is not absolutely necessary. On the exterior of the rear side of each tray 14 and equidistant from the center, there is preferably a pair of the V-shaped or U-shaped collars, saddles, or sleeves 78. The pair of V-shaped or U-shaped collars, saddles, or sleeves 78 should span beyond the pushpin ports 28, 30 on the rear side of each tray 14. The narrow, apex ends of the collars, saddles, or sleeves 78 should point upward, while the wider, open ends should point downward. Furthermore, such collars, saddles, or sleeves 78 should have inwardly-flared side edges such that the flared head of a screw, nail, or other fastening device 90, or the V-shaped or U-shaped complementary inserts 88 of a wall-mounting brace 84, can be received and held snugly within the collars, saddles, or sleeves 78. The particular wall-mounting brace 84 shown in the figures comprises a sturdy wire or tube arcuately shaped, such that the brace has an outer pair of V-shaped or U-shaped portions 88—which outer pair members 88 are dimensioned to fit snugly within the tray's wall-mounting collars, saddles, or sleeves 78—at its sides, and such that the brace 84 has an inner pair of V-shaped or U-shaped portions 86—which inner pair members 86 are welded to a pair of washers 87 for flush attachment to a wall using screws, nails, or rivets 90. The inner pair of V-shaped or U-shaped portions 86 should also be offset (closer to the wall) from the outer pair of V-shaped or U-shaped portions 88 in order to accommodate the rear pillar 40, which also attaches to the tray(s) 10 from the rear.

A preferred embodiment of the present invention has the following general dimensions: each pillar is roughly 500 mm high/long, roughly 150 mm wide, and roughly 10 mm deep (due to the various folds and embossed structures; the panel material/stock material is on the order of a few millimeters thick); the lateral pairs of pushpin ports on the pillars 40 are vertically spaced apart by roughly 40 mm; within each pair of pushpin ports, there is roughly 110 mm distance between them, thus there is also roughly 110 mm distance between the ports on each side of the trays 10 with respect to each horizontal grouping and each inclined grouping; the pillar-binding turnkeys and corresponding cylindrical protrusions and depressions are on the order of about 20 mm wide; each tray is roughly 450 mm wide, roughly 230 mm deep (front side to rear side), and roughly 70 mm tall (tray bottom to the highest point of any side); the inclined-positioning ports of each tray (except for the shared, front pair of ports) or approximately 25 mm below the horizontal-positioning ports; the inclined or tilt angle of the front and rear sides of each tray relative to the tray bottom is roughly 10 to 15° (degrees) from perpendicular; the distance between each tray's wall-mounting collars, and thus the distance between the wall-mounting brace's outer pair of V-shaped or U-shaped structures, is approximately 230 mm. Note, however, that these dimensions are peculiar to merely one of many possible embodiments, and such dimensions are not meant to be limiting.

All of the dimensions provided for the described embodiments can be easily varied in order to meet the needs of any particular display rack. While there are many standard sizes of commercial display racks, there can be significant variations that would necessitate adjustments to the required dimensions. The specific embodiment disclosed is most suitable for the display of single-serving size salty snack packages, such as bags of potato chips and tortilla chips. However, the invention is suitable for the display of any product that is amenable to modular display units and/or a gravity feed system, such as bagged products, canned products, books, pamphlets, boxed products, canisters and bundled products. While specific embodiments of the invention have been disclosed, one of ordinary skill in the art will recognize that one can modify the dimensions and particulars of the embodiments without straying from the inventive concept.

We claim:

1. A modular display rack unit comprising:

a first tray and a second tray, wherein each one of said trays comprises a left tray panel, a right tray panel, a front tray panel, a rear tray panel, and a bottom tray panel;

a first pillar, a second pillar, and a third pillar;

wherein each one of said trays further comprises a plurality of ports, which ports can be described more specifically as:

a front pair of ports on the left and right tray panels;

an upper rear pair of ports on the left and right tray panels;

a lower rear pair of ports on the left and right tray panels;

an upper pair of ports on the rear tray panel;

a lower pair of ports on the rear tray panel;

wherein the front pair of ports on the left and right tray panels, the upper rear pair of ports on the left and right tray panels, together with the upper pair of ports on the rear tray panel, define a plane that parallels the bottom tray panel;

wherein the front pair of ports on the left and right tray panels, the lower rear pair of ports on the left and right tray panels, together with the lower pair of ports on the rear tray panel, define a plane that forms an acute angle with a plane containing the bottom tray panel;

wherein each one of said pillars has a plurality of lateral pairs of ports, and said lateral pairs of ports are distributed across the length of each pillar;

wherein the second tray is aligned above the first tray, and the first and second trays are spaced apart and secured in their relative positions by shared attachment to the first, second, and third pillars such that: the first pillar is adjacent to the trays' left tray panels; the second pillar is adjacent to the trays' right tray panels; and the third pillar is adjacent to the trays' rear tray panels;

wherein said shared attachment is accomplished by installment of a plurality of pushpin fasteners through appropriately-aligned sets of the ports on adjacent trays and pillars;

wherein each of said ports comprises a hole for receiving said pushpin fasteners; wherein each of said trays is adjustable between two orientations, a first non-gravitational-feed orientation and a second gravitational-feed orientation; and wherein said orientations are determined by the alignment of the respective pairs of ports of the pillars and a respective tray.

2. The modular display rack unit of claim 1 wherein each pillar comprises a formed panel material having complementary top and bottom structures for stacking and interlocking two or more pillars vertically, thereby enabling two or more modular display rack units to be stackable.

3. The modular display rack unit of claim 2 wherein said complementary top and bottom structures of each pillar comprise:

a) a trapezoid-like shaped portion of the panel material extending from the top of the pillar;

b) an upper cylindrical keyhole-containing portion, located within the trapezoid-like shaped portion, that is offset from the rest of the panel material toward an exterior side of the pillar, thereby leaving a cylindrical depression on an interior side of the pillar and a cylindrical protrusion on the exterior side;

c) a trapezoid-like embossed boundary, located at the bottom of the pillar;

d) a lower cylindrical keyhole-containing portion, within the confines of the trapezoid-like embossed boundary, that is offset from the rest of the panel material toward the exterior side of the pillar, thereby leaving a cylindrical protrusion on the exterior side.

4. The modular display rack unit of claim 1 wherein said trays and pillars further comprise a plurality of surface cross-members.

5. The modular display rack unit of claim 1 wherein the interior faces of each one of said trays are structurally reinforced by a plurality of interior buttresses, each of which buttresses extends perpendicularly and downward from the upper portion of its respective interior tray face to the interior surface of its respective bottom tray panel.

6. The modular display rack unit of claim 1 wherein the bottom tray panel of each one of said trays defines a plurality of triangular spaces dispersed in alternating orientations throughout the bottom tray panel.

7. The modular display rack unit of claim 1 wherein each one of said pillars comprises a panel material having a plurality of longitudinal, alternating, orthogonal folds.

8. The modular display rack unit of claim 1 wherein each one of said trays further comprises: a tray divider having three prongs; and a plurality of triplets of holes, where each triplet runs parallel to the left and right tray panels.

9. The modular display rack unit of claim 1 further comprising a plurality of placard holders.

* * * * *